US007997205B2

(12) United States Patent
Greenwood et al.

(10) Patent No.: US 7,997,205 B2
(45) Date of Patent: Aug. 16, 2011

(54) BASE DRAG REDUCTION FAIRING

(75) Inventors: Kevin R. Greenwood, Tucson, AZ (US); James D. Streeter, Oro Valley, AZ (US); Jeremy C. Danforth, Tucson, AZ (US); Timothy A. Yoder, Sahuarita, AZ (US)

(73) Assignee: Raytheon Company, Waltham, MA (US)

( * ) Notice: Subject to any disclaimer, the term of this patent is extended or adjusted under 35 U.S.C. 154(b) by 133 days.

(21) Appl. No.: 12/463,260

(22) Filed: May 8, 2009

(65) Prior Publication Data

US 2010/0282116 A1 Nov. 11, 2010

(51) Int. Cl.
*F42B 15/01* (2006.01)

(52) U.S. Cl. ..... 102/490; 244/3.3; 102/501

(58) Field of Classification Search ..... 102/490, 102/501; 244/3.3, 3.24, 3.27
See application file for complete search history.

(56) References Cited

U.S. PATENT DOCUMENTS

| | | | | | |
|---|---|---|---|---|---|
| 1,746,397 | A | * | 2/1930 | Johnson | 102/439 |
| 1,817,377 | A | * | 8/1931 | James | 244/3.27 |
| 2,036,292 | A | * | 4/1936 | Moore | 102/501 |
| 2,055,765 | A | * | 9/1936 | Hayden | 244/3.25 |
| 2,297,130 | A | * | 9/1942 | Bomar | 244/3.27 |
| 2,324,346 | A | * | 7/1943 | Albree | 244/3.1 |
| 3,292,879 | A | * | 12/1966 | Seward | 244/3.3 |
| 3,412,962 | A | * | 11/1968 | Killian | 244/130 |
| 3,809,339 | A | * | 5/1974 | Sieling et al. | 244/3.3 |
| 3,886,009 | A | | 5/1975 | Puchalski | |
| 3,988,990 | A | | 11/1976 | MacDonald et al. | |
| 4,561,357 | A | * | 12/1985 | Maudal et al. | 102/439 |
| 4,674,706 | A | | 6/1987 | Hall | |
| 4,741,569 | A | | 5/1988 | Sutphen | |
| 4,813,635 | A | | 3/1989 | Paterson et al. | |
| 5,058,945 | A | | 10/1991 | Elliott et al. | |
| 5,108,051 | A | * | 4/1992 | Montet et al. | 244/3.28 |
| 5,211,358 | A | * | 5/1993 | Bagley | 244/3.27 |
| 6,126,109 | A | | 10/2000 | Barson et al. | |
| 6,297,486 | B1 | | 10/2001 | Rom et al. | |
| 6,657,174 | B1 | | 12/2003 | Olsson | |
| 6,923,123 | B2 | * | 8/2005 | Rastegar et al. | 102/400 |
| 6,935,242 | B2 | * | 8/2005 | Rastegar et al. | 102/501 |
| 6,982,402 | B1 | * | 1/2006 | Rastegar et al. | 244/3.1 |
| 7,150,232 | B1 | * | 12/2006 | Rastegar et al. | 102/501 |
| 7,255,044 | B2 | | 8/2007 | Rastegar et al. | |
| 7,578,238 | B1 | * | 8/2009 | Dabiri | 102/490 |
| 2003/0047645 | A1 | * | 3/2003 | Rastegar et al. | 244/3.24 |
| 2003/0146342 | A1 | * | 8/2003 | Hellman | 244/3.27 |
| 2005/0133661 | A1 | * | 6/2005 | Rastegar et al. | 244/3.24 |
| 2010/0032516 | A1 | * | 2/2010 | Olden et al. | 244/3.27 |
| 2010/0102161 | A1 | * | 4/2010 | Geswender et al. | 244/3.27 |

FOREIGN PATENT DOCUMENTS

| | | | | |
|---|---|---|---|---|
| DE | 2136002 | A1 | * | 2/1973 |
| FR | 714676 | A | * | 11/1931 |
| GB | 2394029 | A | * | 4/2004 |

* cited by examiner

*Primary Examiner* — Benjamin P Lee
(74) *Attorney, Agent, or Firm* — SoCal IP Law Group LLP; John E. Gunther; Steven C. Sereboff

(57) ABSTRACT

A projectile may include a base drag reduction fairing preform adapted to be plastically deformed into a base drag reduction fairing after the projectile is launched from a gun barrel.

16 Claims, 7 Drawing Sheets

BASE DRAG REDUCTION FAIRING

NOTICE OF COPYRIGHTS AND TRADE DRESS

A portion of the disclosure of this patent document contains material which is subject to copyright protection. This patent document may show and/or describe matter which is or may become trade dress of the owner. The copyright and trade dress owner has no objection to the facsimile reproduction by anyone of the patent disclosure as it appears in the Patent and Trademark Office patent files or records, but otherwise reserves all copyright and trade dress rights whatsoever.

BACKGROUND

1. Field

This disclosure relates to projectiles and in particular to increasing the range of projectiles.

2. Description of the Related Art

Any object moving through air is subject to various forces that act in a direction opposed to the direction of motion and thus tend to retard the motion. One such first commonly called "base drag" which is the force caused by a low pressure region formed behind a moving object. In oversimplified terms, the moving object leaves a partial vacuum in the space that the object has just vacated. Base drag is particularly severe for objects, such as projectiles and trucks, which end abruptly with a rear surface roughly normal to the direction of motion.

The base drag of projectiles may be reduced by increasing turbulence near the rear of a projectile such that the adjacent air fills the space being vacated by the moving projectile more quickly. U.S. Pat. No. 6,297,486 and U.S. Pat. No. 4,813,635 describe projectiles with features intended to reduce base drag.

The base drag of projectiles may be reduced or eliminated by filling the space being vacated by the projectile with gas generated within the projectile. U.S. Pat. No. 6,297,486 and U.S. Pat. No. 4,813,635 describe projectiles that burn a fuel material to produce gas that is exhausted through the base of the projectile to reduce base drag. This approach to reducing base drag is commonly referred to as "base bleed". The addition of a base bleed generator to a projectile increases the projectile cost and, due to the need to store the base bleed fuel, reduces the volume within the projectile that is available for other content.

Virtually all modern munitions are required to be "insensitive". Insensitive munitions are munitions that minimize the probably of inadvertent ignition or detonation, and which minimize the severity of collateral damage to weapons platforms, other equipment and personnel if inadvertent ignition should occur. Specifically, insensitive munitions are munitions that do not react more violently than burning when subjected to slow or fast heating; fragment, bullet, spall, or shaped charge impact; or detonation of an adjacent similar motor. Requirements for insensitive munitions are generally described in MIL-STD-2105B, Hazard Assessment Test for Non-Nuclear Ordinance. Specific test requirements are described in NATO STANAG (Standardization Agreement) documents.

Significantly, base bleed generators typically generate gas using fuel materials that are slow burning but easily ignitable. The use of easily ignitable base bleed fuel materials may complicate or preclude the projectile from complying with various insensitive munitions requirements.

Base drag may also be reduced by modifying the shape of the rear of the moving object. U.S. Pat. No. 4,674,706 describes a projectile including a telescoping extension to reduce base drag at the rear of the projectile. U.S. Pat. No. 6,657,174 describes a projectile including an inflatable extension to reduce base drag at the rear of the projectile.

Throughout this description, each element appearing in a figure is assigned a unique three-digit reference designator, where the most significant digit is the figure number where the element was introduced. An element that is not described in conjunction with a figure may be presumed to have the same characteristics and function as a previously-described element having the same reference designator.

DETAILED DESCRIPTION

Description of Apparatus

Figures 1A, 1B, 1C:
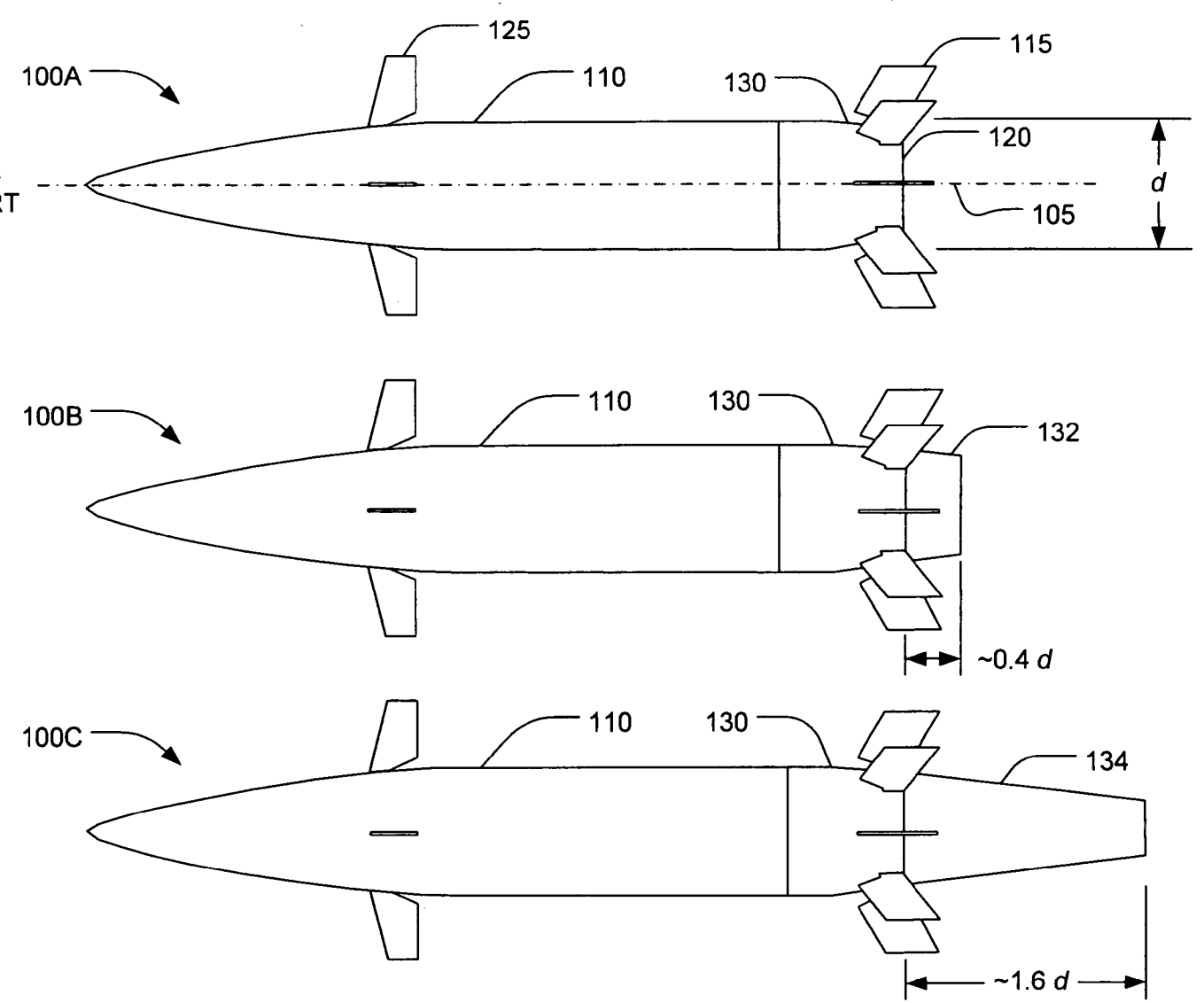
FIG. 1A PRIOR ART
FIG. 1A is a side view of a conventional projectile.
FIG. 1B is a side view of a projectile with a base drag reduction fairing.
FIG. 1C is a side view of a projectile with a base drag reduction fairing.

Referring now to FIG. 1A, a conventional projectile 100A may include a projectile body 110A. The projectile body 110 may include a projectile base 130. The projectile body 110A and the projectile base 130 may be rotationally symmetric about a projectile axis 105 and may have a circular cross section with a maximum diameter d. A plurality of fins 115 may be deployed from the projectile base 130. In the case of a guided projectile, one or more control surfaces may be disposed on the projectile body. In the example of FIG. 1A, the control surfaces may be a plurality of canards 125 disposed on the projectile body 110 forward of the plurality of fins 115. The control surfaces may be canards, fins, wings, scoops, brakes, and other elements usable to control the trajectory of the projectile. A portion of the projectile base 130 proximate a back end 120 of the projectile may have a taper, commonly called a "boat tail", which may be effective to reduce base drag when the projectile is traveling through air.

FIG. 1B and FIG. 1C show projectiles 100B and 100C which include base drag reduction fairings which may be deployed after the projectiles are launched or fired from a gun. In the application, the term "fairing" is used with its conventional definition of "a structure in aircraft design used to reduce drag". Each of the projectiles shown in FIG. 1A, FIG. 1B, and FIG. 1C may be essentially the same length prior to launch. After launch, the projectiles shown in FIG. 1B and FIG. 1C deploy a base drag reduction fairing which extends the length of the projectiles relative to the length of the projectile shown in FIG. 1A. FIG. 1B shows a projectile 100B including a base drag reduction fairing 132 that extends the length of the projectile 100B by about 0.4 times the projectile diameter d. FIG. 1C shows a projectile 100C including a base drag reduction fairing 134 that extends the length of the projectile 100C by about 1.6 times the projectile diameter d. Each of the base drag reduction fairings 132, 134 may taper toward the back such that a diameter of the back of the fairing may be less than a diameter where the fairing abuts the projectile base 130. Each of the base drag reduction fairings 132, 134 may continue the boat tail taper of the projectile base 130.

Figure 2:
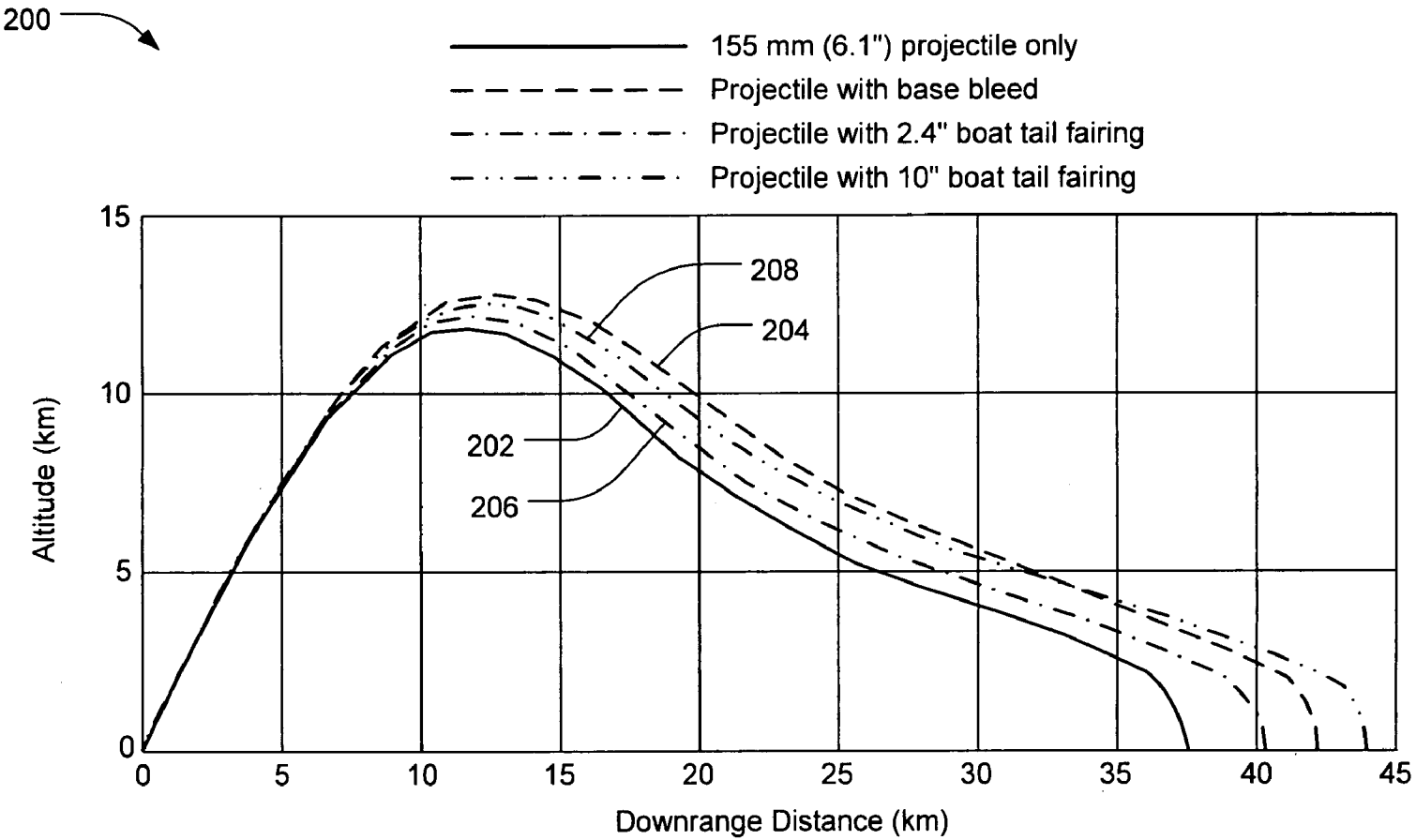
FIG. 2 is a graph of showing the simulated performance of various projectiles.

FIG. 2 shows the simulated performance of various 155 mm (6.1" diameter) artillery projectiles. Specifically, FIG. 2 shows a graph 200 of the altitude and down-range distance for various 155 mm artillery projectiles using identical firing conditions. The solid line 202 shows the performance of a projectile that does not have base bleed or a base drag reduction fairing. The range of the projectile without base bleed or a base drag reduction fairing is 37.5 kilometers.

The dashed line 204 shows the altitude and down-range distance for the same 155 mm artillery projectile with the addition of base bleed. The range of the projectile with base bleed is 42 kilometers. Thus, for the simulated conditions, the incorporation of base bleed increase the range of the projectile by about 12%.

The broken lines 206, 208 show the altitude and down-range distance for the same 155 mm artillery projectile with the addition of base drag reduction fairings. The line 206 (dot-dash) shows the range of the projectile with a 2.4" long (about 0.4 times the projectile diameter) base drag reduction fairing is about 40.5 kilometers. The line 208 (dot-dot-dash) shows the range of the projectile with a 10" long (about 1.6 times the projectile diameter) base drag reduction fairing is about 44 kilometers. Thus, for the simulated conditions, a base drag reduction fairing may increase the range of the projectile by about 7% to 17%, depending on the length of the fairing. Although the specific design was not simulated, the information in FIG. 2 indicates that the performance of a projectile with a base drag reduction fairing may be about equal to the performance of a projectile with base bleed if the length of the base drag reduction fairing is about equal to the diameter of the projectile.

Figure 3:
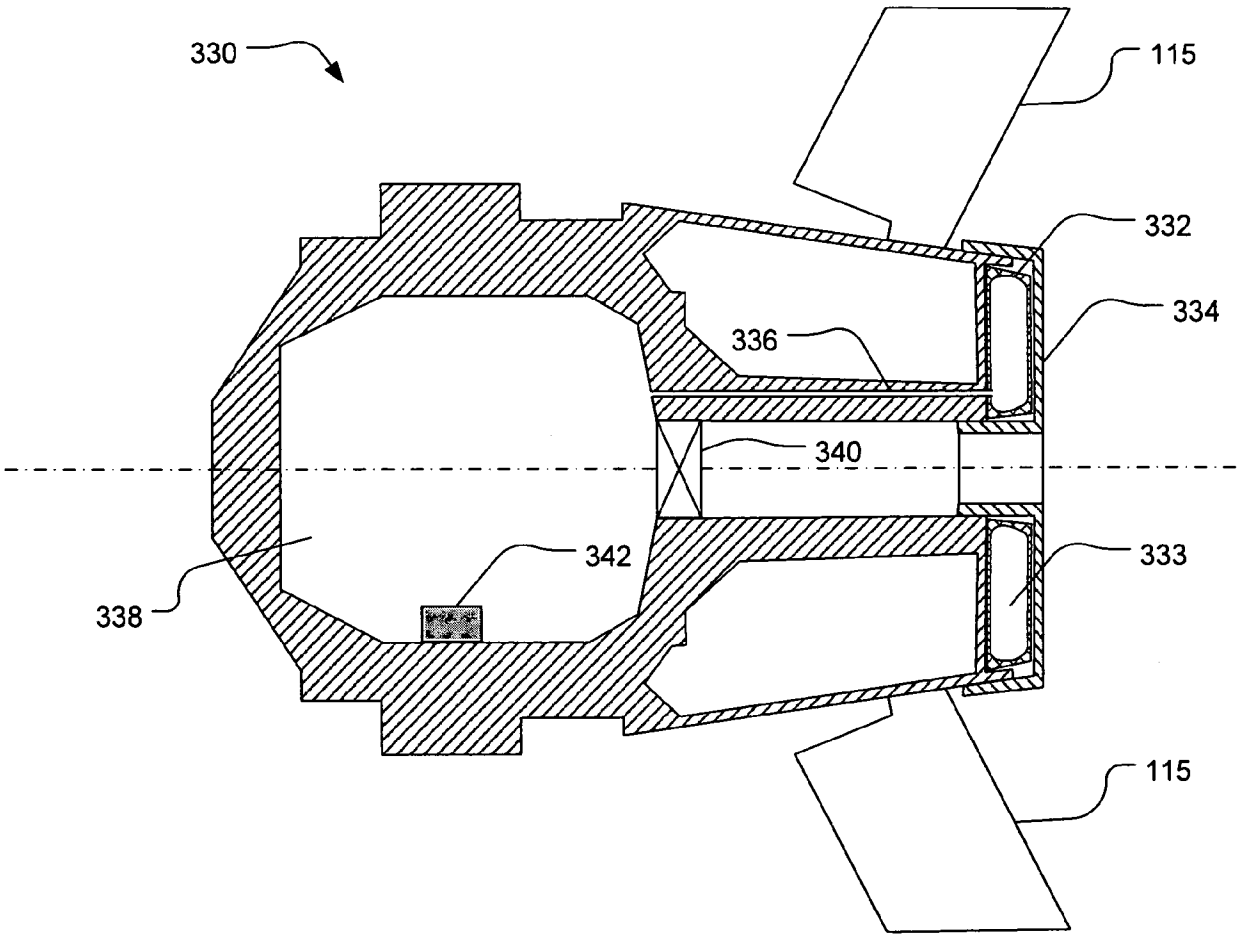
FIG. 3 is a cross-sectional view of a projectile base before deployment of a base drag reduction fairing.

FIG. 3 shows a partial cross-sectional view of a projectile base 330, which may be suitable for use as the base 130, before deployment of a base drag reduction fairing. Although the projectile base 330 is shown in FIG. 3 as a single piece, the projectile base 330 may be comprised of multiple joined sections or pieces. The back 120 of the projectile is shown at the right side of FIG. 3, and the body of the projectile, which is not shown, would extend to the left of the projectile base 330.

An undeployed base drag reduction fairing preform 332, which may be shaped as a hollow annular ring, may be disposed at the back of the projectile base. In this context, the term "preform" is defined as an object having a preliminary shape adapted to be transformed by some process into a final shape. The preform 332 may be concealed and protected by an ejectable cover 334. The ejectable cover 334 may be adapted to prevent the preform 332 from being crushed or otherwise damaged during handling and launch of the associated projectile.

The interior 333 of the base drag reduction fairing preform 332 may be gaseously coupled to a gas storage reservoir 338 within the projectile base 330, which is say that gas may flow from the reservoir 338 to the interior 333 of the preform 332 through at least one passage 336. During the launch of a projectile from a gun barrel, a propellant material may be ignited to produce combustion gases that fill the closed portion of the gun barrel to a high gas pressure level. The high gas pressure on the back of the projectile may then accelerate the projectile down the length of the barrel. During launch of a projectile equipped with the projectile base 330, the reservoir 338 may be filled with high pressure combustion gases via a one-way valve 340. The one-way valve may be adapted to allow reservoir 338 to fill with gas to a pressure equal or nearly equal to the peak gas pressure in the gun barrel. Since the reservoir 338 is coupled to the interior volume 333 of the preform 332 via the passage 336, the interior volume 333 of the preform 332 may also fill with gas to a pressure equal or nearly equal to the peak gas pressure in the gun barrel.

Once the projectile has exited the gun barrel, the exterior surfaces of the projectile may be exposed to the atmosphere at normal ambient air pressure. The high pressure differential between the gas stored in the reservoir 338 and the interior 333 of the preform 332 and the atmosphere external to the projectile may cause the preform 332 to plastically deform into the desired base drag reduction fairing, such as the base drag reduction fairings 132, 134 shown in FIG. 1B and FIG. 1C, respectively. Plastic deformation, as opposed to elastic deformation or stretching, is generally permanent. In contrast to inflatable fabric fairings, a base drag reduction fairing deployed by plastic deformation of a preform may retain the desired shape without requiring that a high gas pressure be maintained within the interior of the fairing.

The process of forming a base reduction fairing by plastic deformation of a preform is similar to deep drawing processes commonly used to form metal parts. The cross-sectional shape of the preform 332, as well as the magnitude of the gas pressure within the preform after launch, will determine the shape of the deployed base drag reduction fairing. Similarly, deep drawing relies on the shape of a preform to determine, at least in part, the shape and wall thickness of the resulting drawn part. The base drag reduction faring preform 332 may be made of an aluminum alloy, stainless steel, or another metallic material amenable to plastic deformation. Materials amenable to plastic deformation are commonly used in deep drawing and other forming processes.

The techniques and knowledge used to design preform shapes for deep drawing may be applied to the design of the base drag reduction fairing preform 332. For example, the required cross-sectional shape of the preform 332 may be established by iterative modeling of the formation process using a finite element modeling tool, possibly in combination with experimentation with alternative preform shapes. Although the base drag reduction fairing preform 332 is shown in FIG. 3 as a single piece, the preform 332 may be assembly from multiple elements joined by, for example, welding, brazing, or other attachment process.

The projectile base 330 may include a gas generator 342 which may be ignited to provide additional gas pressure to deploy the base drag reduction fairing. For ease of illustration, the gas generator 342 is shown in FIG. 3 within the reservoir 338. The gas generator 342 may be located elsewhere within the projectile base 330 and gaseously coupled to the interior 333 or the preform 332. The drag reduction fairing may be deployed using only gas generated by the gas generator 342, in which case the one-way valve 340 is not required.

Figure 4:
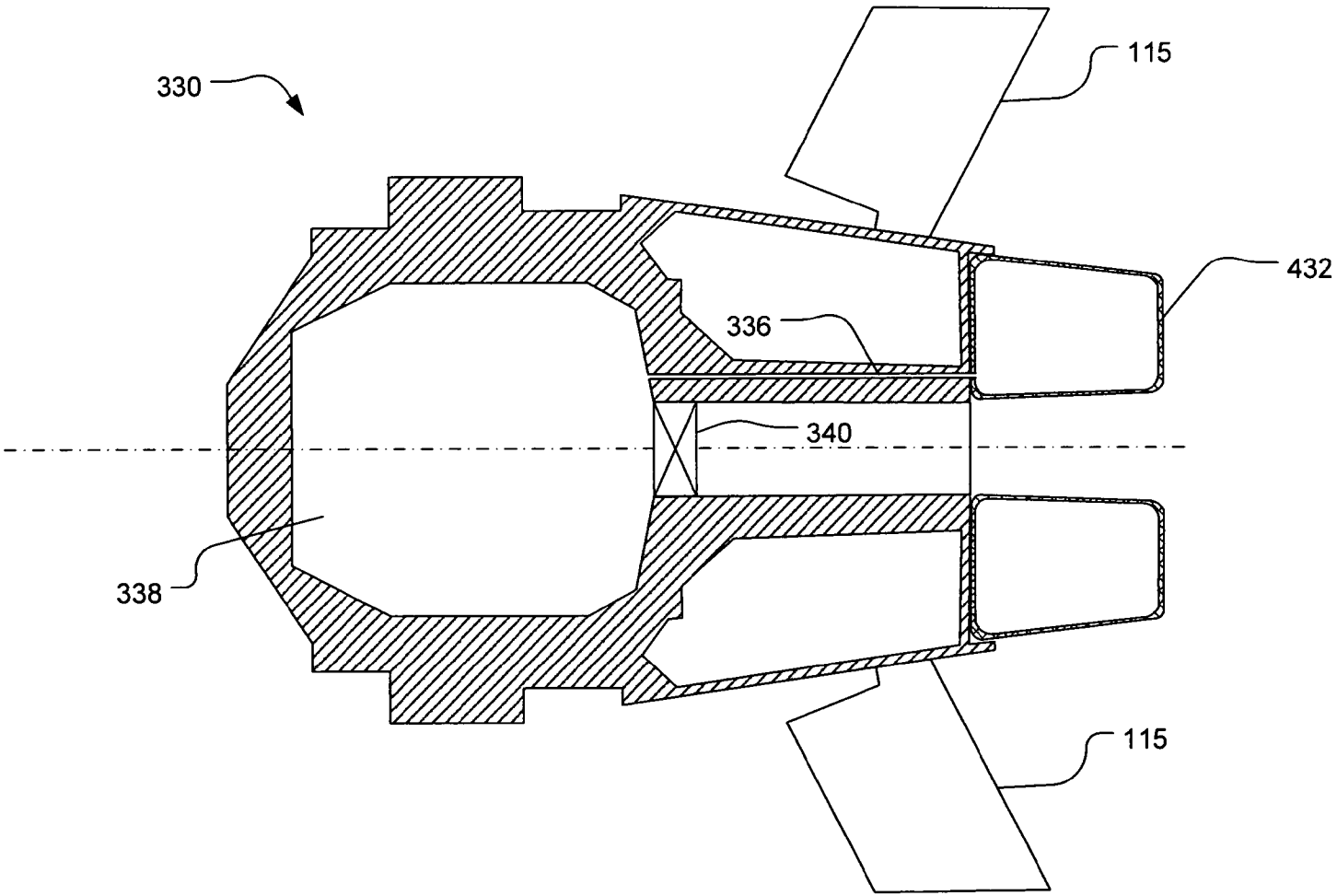
FIG. 4 is a cross-sectional view of a projectile base after deployment of a base drag reduction fairing.

FIG. 4 shows a partial cross-sectional view of the projectile base 330 after deployment of the base drag reduction fairing 432. The cover (334 in FIG. 3) that initially enclosed the base drag reduction fairing preform (332 in FIG. 3) has been ejected and is not shown. The preform has been deformed into the desired base drag reduction fairing 432. The cover may have been ejected by air drag upon launch of the projectile, by the action of the expanding base drag reduction fairing 432, or by some other mechanism. The gas pressure in the reservoir 338 and interior of the base drag reduction fairing 432 may have been release or may have fallen to a level insufficient to cause addition deformation of the base drag reduction fairing 432.

Figure 5:
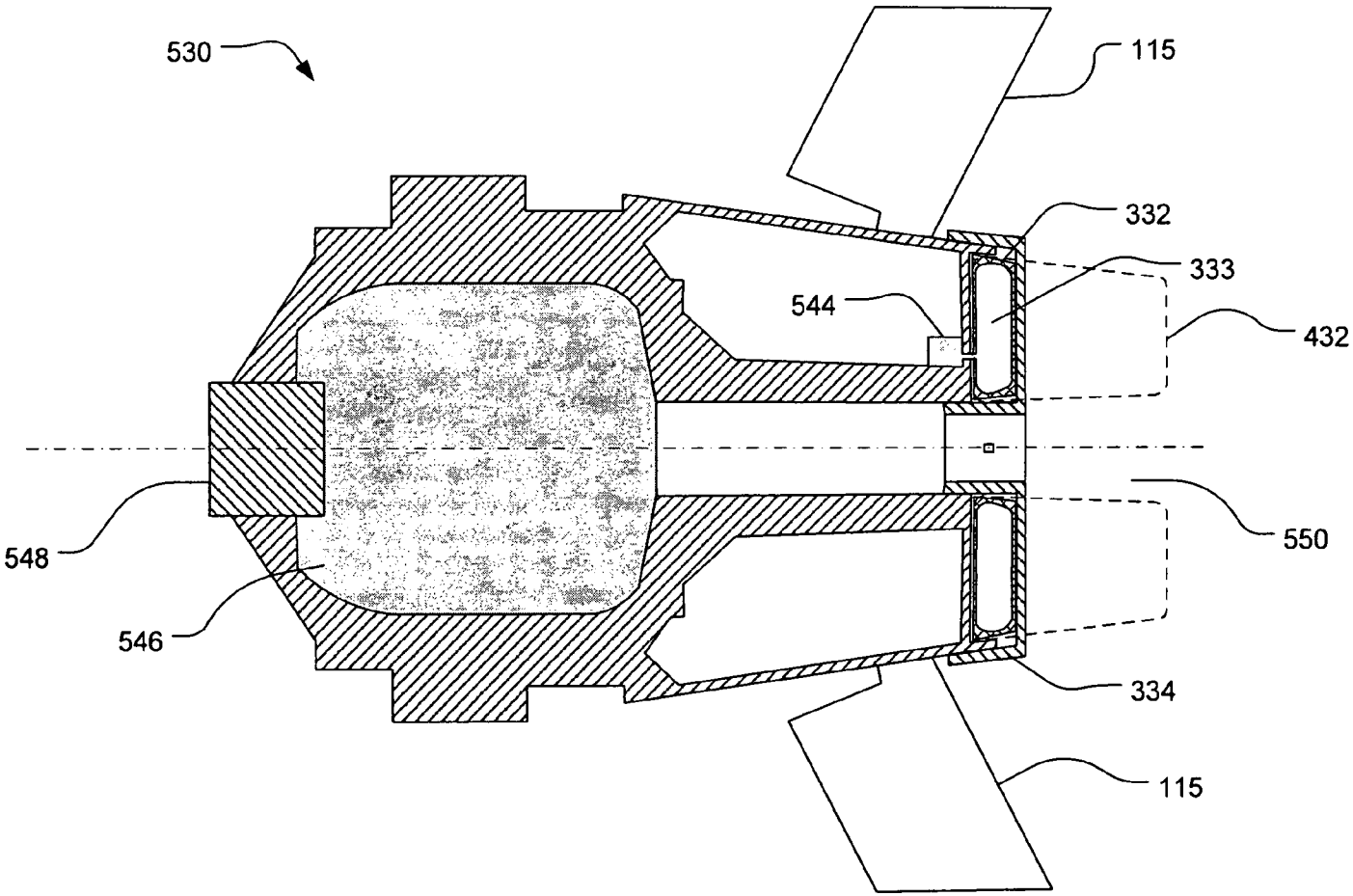
FIG. 5 is a cross section view of a projectile base which includes base bleed and a base drag reduction fairing.

FIG. 5 shows a partial cross-sectional view of a projectile base 530, which may be suitable for use as the base 130, before deployment of a base drag reduction fairing. The projectile base 530 includes a base drag reduction fairing preform 332 protected by an ejectable cover 334, a gas generator 544, and a base bleed generator including a base bleed fuel supply 546, and a base bleed igniter 548.

The interior 333 of the base drag reduction fairing preform 332 may be gaseously coupled to the gas generator 544. After the launch of a projectile from a gun barrel, the gas generator 544 may be ignited to produce combustion gases that fill the interior 333 of the preform 332 to a high pressure level. The high pressure difference between the interior 333 of the preform 332 and the atmosphere external to the projectile after launch may cause the preform 332 to plastically deform into the desired base drag reduction fairing 432 as previously described.

After launch, the base bleed igniter 548 may be fired to ignite the base bleed fuel supply 546 to provide base bleed gases. The base bleed gases may be discharged from the projectile base 530 via a passage 550 through the center of the base drag reduction fairing 432. The base bleed igniter 548, the base bleed fuel supply 546, and the passage 550 collectively resemble a solid fuel rocket motor. However, the base bleed generators may be designed to discharge base bleed gas at a rate sufficient to fill the vacuum formed behind the moving projectile and generally do not produce useful thrust.

For convenience in preparing the drawings in this patent, the gas reservoir 338 in FIG. 3 and the base bleed fuel supply 546 in FIG. 4 are shown as having the same size and shape. This is an artifact of these drawings. There are no technical reasons why a reservoir within a first projectile base should have the same size and volume as a base bleed fuel supply within a different projectile base. Further, although not shown, a projectile base may contain both a reservoir to capture gun gases during launch and a base bleed fuel supply.

Description of Processes

Figure 6:
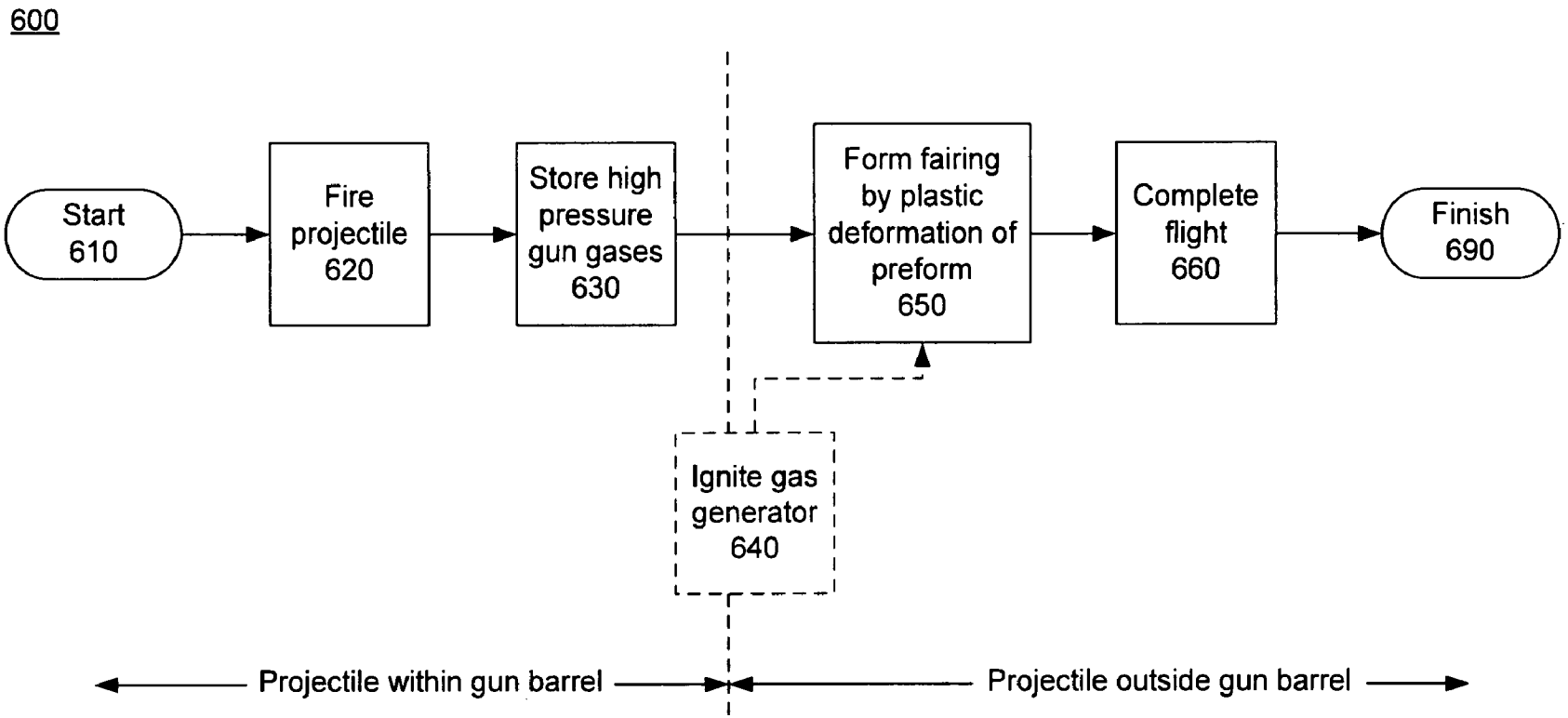
FIG. 6 is a flow chart of a method for operating a projectile.

Referring now to FIG. 6, a flow chart of a process 600 for operating a projectile has a start at 610, which may be when the projectile is loaded into a gun, and a finish at 690, which may be when the projectile detonates or impacts a target. To load the gun, a propellant charge and the projectile may be placed at the closed end of an elongate gun barrel. At 620, the gun may be fired to launch the projectile. To fire the gun, the propellant charge may be ignited to produce combustion gases that result in very high gas pressure within the barrel. The high gas pressure may then accelerate the projectile along the length of the barrel such that the projectile exits an open end of the barrel at a high velocity.

At 630, after the propellant charge has been ignited and while the projectile is still within the gun barrel, a portion of the combustion gases may be captured and stored at high pressure within the projectile. For example, a reservoir within the projectile may be filled with combustion gases through a pressure-activated one-way valve that allows gases to flow from the gun barrel into the reservoir, but does not allow gas to flow out of the reservoir. In this manner, the gases stored in the reservoir may be at a gas pressure equal to, or nearly equal to, the peak gas pressure in the barrel when the gun is fired.

At 640, before or after the projectile exits the gun barrel, a gas generator within the projectile may be ignited to produce additional combustion gases. The gas generator within the projectile may be similar in function to the gas generators that inflate automotive airbags.

At 650, a base drag reduction fairing may be deployed using pressure from the combustion gases stored at 630, or the gas produced at 640, or a combination of gases stored at 630 and produced at 640. The base drag reduction fairing may be deployed by applying the pressure from the captured and/or generated gas to an interior volume of a preform designed to plastically deform into the desired shape of the base drag reduction fairing. After the base drag reduction fairing is deployed at 650, the projectile may continue guided or unguided flight at 660 until the flight terminates by detonation or impact at 690.

Figure 7:
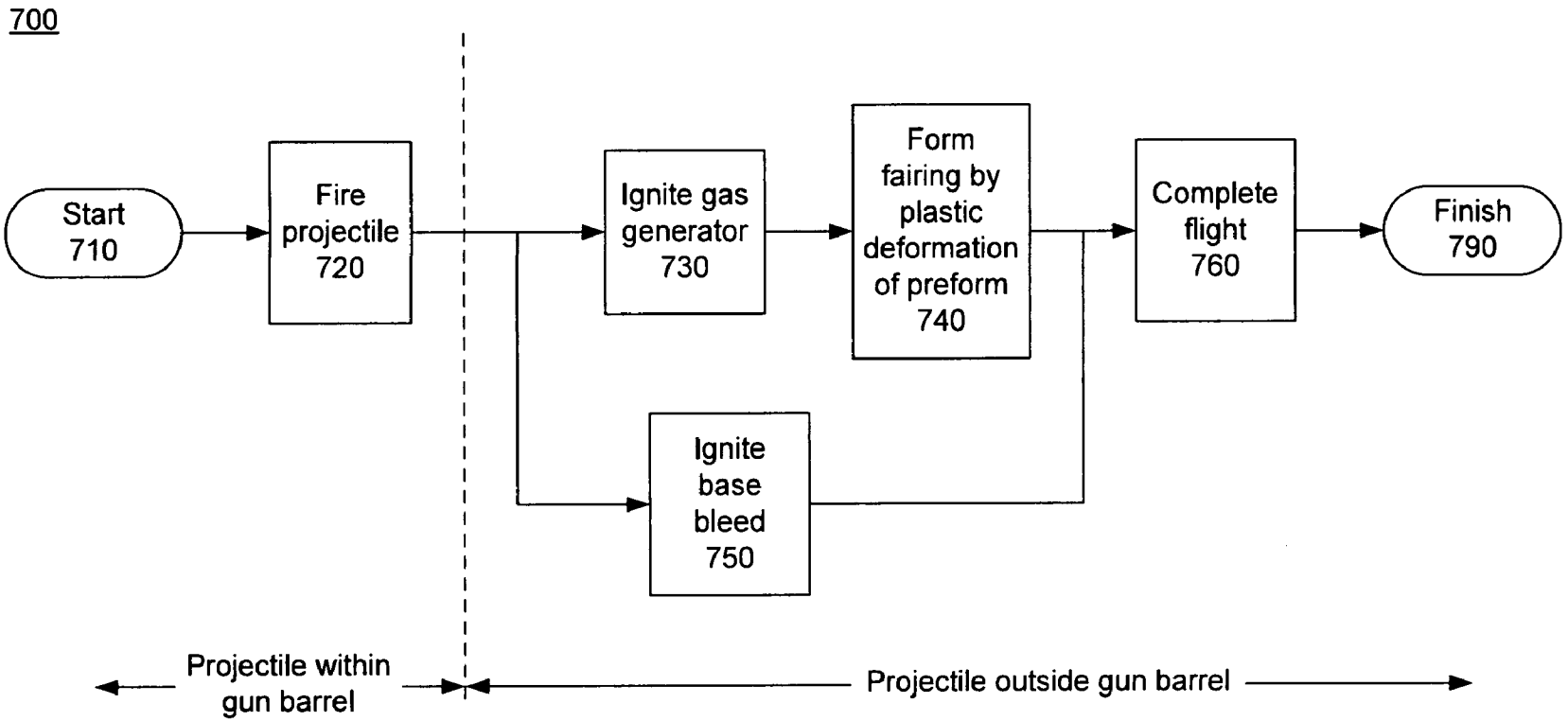
FIG. 7 is a flow chart of a method for operating a projectile.

Referring now to FIG. 7, a flow chart of a process 700 for operating a projectile has a start at 710, which may be when the projectile is loaded into a gun, and a finish at 790, which may be when the projectile detonates or impacts a target. To load the gun, a propellant charge and the projectile may be placed at the closed end of an elongate gun barrel. At 720, the gun may be fired to launch the projectile. To fire the gun, the propellant charge may be ignited to produce combustion gases that result in very high gas pressure within the barrel. The high gas pressure may then accelerate the projectile along the length of the barrel such that the projectile exits an open end of the barrel at very high velocity.

At 730, after the projectile exits the gun barrel, a gas generator within the projectile may be ignited to produce combustion gases at high pressure. The gas generator within the projectile may be similar in form and function to the gas generators that inflate automotive airbags.

At 740, a base drag reduction fairing may be deployed using pressure from the combustion gases produced at 730. The base drag reduction fairing may be deployed by applying the pressure from the generated gas to an interior volume of a preform designed to plastically deform into the desired shape of the base drag reduction fairing.

Concurrently with or after the base drag reduction fairing is deployed at 740, a base bleed fuel supply may be ignited at 750 to provide base bleed gas. The base bleed gas may be discharged at the rear of the projectile to fill the vacuum that forms behind the moving projectile and thus further reduce base drag. The projectile may continue guided or unguided flight at 760 until the flight terminates by detonation or impact at 790.

Closing Comments

Throughout this description, the embodiments and examples shown should be considered as exemplars, rather than limitations on the apparatus and procedures disclosed or claimed. Although many of the examples presented herein involve specific combinations of method acts or system elements, it should be understood that those acts and those elements may be combined in other ways to accomplish the same objectives. With regard to flowcharts, additional and fewer steps may be taken, and the steps as shown may be combined or further refined to achieve the methods described herein. Acts, elements and features discussed only in connection with one embodiment are not intended to be excluded from a similar role in other embodiments.

For means-plus-function limitations recited in the claims, the means are not intended to be limited to the means disclosed herein for performing the recited function, but are intended to cover in scope any means, known now or later developed, for performing the recited function.

As used herein, "plurality" means two or more.

As used herein, a "set" of items may include one or more of such items.

As used herein, whether in the written description or the claims, the terms "comprising", "including", "carrying", "having", "containing", "involving", and the like are to be understood to be open-ended, i.e., to mean including but not limited to. Only the transitional phrases "consisting of" and "consisting essentially of", respectively, are closed or semi-closed transitional phrases with respect to claims.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

As used herein, "and/or" means that the listed items are alternatives, but the alternatives also include any combination of the listed items.

The invention claimed is:

1. A projectile comprising:

a high pressure gas source; and a base drag reduction fairing preform adapted to be plastically deformed into a base drag reduction fairing in response to application of high pressure gas from the high pressure gas source after the projectile is launched from a gun barrel, wherein the base drag reduction fairing, once formed, is configured to maintain its shape without requiring continuous high gas pressure within a hollow interior of the base drag reduction fairing.

2. The projectile of claim 1, wherein the preform comprises an annular ring having a hollow interior, the preform adapted to plastically deform into the base drag reduction fairing in response to high pressure gas provided to the interior of the preform.

3. The projectile of claim 2, wherein the high pressure gas source comprises:

a gas generator gaseously coupled to the interior of the preform.

4. The projectile of claim 1, further comprising:

a base bleed generator to generate base bleed gas, wherein the base bleed gas exits the projectile via a central passage in the base drag reduction fairing.

5. The projectile of claim 2, wherein the high pressure gas source comprises:

a reservoir configured to store high pressure gun gases received via a one-way valve during the launch of the projectile.

6. The projectile of claim 5, wherein, after the projectile exits the gun, high pressure gas stored in the reservoir is used to deploy the base drag reduction fairing.

7. The projectile of claim 6, wherein the high pressure gas source further comprises:

a gas generator, wherein, after the projectile exits the gun barrel, the base drag reduction fairing is deployed by a combination of high pressure gas stored in the reservoir and gas generated by the gas generator.

8. A method of operating a projectile, comprising:

launching the projectile from a gun; and after the projectile exits the gun, applying high gas pressure to plastically deform a preform into a base drag reduction fairing, wherein the base drag reduction fairing, once formed, is configured to maintain its shape without continuous application of high gas pressure.

9. The method of claim 8, wherein deploying the base drag reduction fairing comprises:

plastically deforming the preform using pressure from gases produced by a gas generator within the projectile.

10. The method of claim 8, wherein deploying the base drag reduction fairing comprises:

storing high pressure gun gases during the launch of the projectile; and after the projectile exits the gun, plastically deforming the preform using pressure from the stored gun gases.

11. The method of claim 8, wherein deploying the base drag reduction fairing comprises:

storing high pressure gun gases during the launch of the projectile; and after the projectile exits the gun, plastically deforming the preform using pressure from a combination of the stored gun gases and gases produced by a gas generator within the projectile.

12. The method of claim 8, further comprising:

after the projectile exits the gun, igniting a base bleed fuel supply to generate base bleed gas.

13. The method of claim 12, further comprising:

discharging the base bleed gas via a central passage through the base drag reduction fairing.

14. A preform comprising:

an annular ring having a hollow interior, wherein the preform is adapted to plastically deform into a base drag reduction fairing in response to high pressure gas provided to the interior of the preform, and wherein the base drag reduction fairing, once formed, is configured to maintain its shape without requiring continuous high gas pressure within the hollow interior.

15. A projectile comprising:

a base drag reduction fairing preform adapted to be plastically deformed into a base drag reduction fairing after the projectile is launched from a gun barrel; and a base bleed generator to generate base bleed gas, wherein the base bleed gas exits the projectile via a central passage in the base drag reduction fairing.

16. A method of operating a projectile, comprising:

launching the projectile from a gun; and after the projectile exits the gun:

deploying a base drag reduction fairing from the projectile by plastically deforming a preform, igniting a base bleed fuel supply to generate base bleed gas, and discharging the base bleed gas via a central passage through the base drag reduction fairing.

* * * * *